US005244407A

United States Patent [19]

Volk et al.

[11] Patent Number: 5,244,407

[45] Date of Patent: Sep. 14, 1993

[54] MULTIPIECE CONNECTOR BACKSHELL ASSEMBLY WITH INTERNAL SUPPORTS

[76] Inventors: William J. Volk, 6015 Carter Ave., Baltimore, Md. 21214; David S. Albert, 105 Mountain Rd., Linthicum, Md. 21090

[21] Appl. No.: 871,606

[22] Filed: Apr. 20, 1992

Related U.S. Application Data

[63] Continuation of Ser. No. 669,256, Mar. 14, 1991, abandoned.

[51] Int. Cl.[5] ..... H07R 13/58; H07R 13/595

[52] U.S. Cl. ..... 439/460; 439/462

[58] Field of Search ..... 439/460, 462, 468–470

[56] References Cited

U.S. PATENT DOCUMENTS

| | | | |
|---|---|---|---|
| 3,879,102 | 4/1975 | Horak | 339/143 R |
| 3,963,321 | 6/1976 | Burger et al. | 339/177 E |
| 4,232,931 | 11/1980 | Takeuchi et al. | 339/258 R |
| 4,533,193 | 8/1985 | Blackwood | 339/65 |
| 4,533,199 | 8/1985 | Feldberg | 339/99 R |
| 4,749,369 | 6/1988 | Wang | 439/460 X |
| 4,832,616 | 5/1989 | Stein, Sr. et al. | 439/279 |

FOREIGN PATENT DOCUMENTS

| | | | |
|---|---|---|---|
| 0936118 | 6/1982 | U.S.S.R. | 439/460 |

OTHER PUBLICATIONS

"Strain Relief For Paddleboard Connectors", J. R. Jan czy, Western Electric Tech. Digest No. 68, Oct. 1982, p. 17.

*Primary Examiner*—Eugene F. Desmond

[57] ABSTRACT

A connector backshell assembly for wires or coaxial cables is provided in which a body and a cover define a housing therefor. An internal support member is mounted within the housing in the form of a split support which secures the wires or cables therebetween. A connector is mounted to the housing at the forward end thereof, which connector electrically engages the wires or coaxial cables. An exit clamp member mounted to such body proximate the aft end thereof, which defines a wide exit window, is provided for further securing such wires or coaxial cables as they exit the housing to thus provide double conductive member support and strain relief where such conductive members engage the connector e.g. when the conductive member or members are bent or twisted relative to the connector backshell assembly.

8 Claims, 3 Drawing Sheets

MULTIPIECE CONNECTOR BACKSHELL ASSEMBLY WITH INTERNAL SUPPORTS

STATEMENT OF GOVERNMENT INTEREST

The invention described herein may be manufactured and used by or for the Government for governmental purposes without the payment of any royalty thereon.

This application is a continuation of application Ser. No. 07/669,256, filed Mar. 14, 1991, now abandoned.

BACKGROUND OF THE INVENTION

1. Field of the Invention

This invention relates to a multipiece connector backshell assembly, particularly one with internal supports.

2. The Prior Art

Cable assemblies employing presently available connectors and backshells, e.g. the "canon" type backshell such as shown in FIGS. 1 and 2 herein, have inherent problems when used with coaxial cable and power type contacts. These problems include 1) the length of the contacts after assembly and the stiffness of the coaxial cables exert high stress on the crimp-locking device within the connector body. 2) Such stiffness limits the bend radius of the cable, reducing and limiting the rear exit window of the backshell that such cables can travel through. 3) The shallow depth of such backshell, the small cable exit window and cable stiffness produce angular distortion on the outermost contacts within, causing them to camber out, e.g. per FIGS. 2 and 3. 4) Such camber produces excessive wear on the contacts when mated and 5) lack of internal support for the cables and/or contacts, places undue stress on the contact locking device when mating and demating (which mating can be difficult).

For examples of coaxial cables confined in terminals to narrow slotted, exit windows see U.S. Pat. No. 4,832,616 to Stein et al. (1989), U.S. Pat. No. 4,533,193 to Blackwood (1985) and U.S. Pat. No. 4,533,199 to Feldberg (1985). Such terminals are characterized by stiffness and bending stress at the cable exit slots thereof. There is thus a need and market for cable terminals, including connector backshell assemblies which impart reduced bending stress to the cable-contact junctions therein and otherwise obviate the above prior art shortcomings.

There has now been discovered an improved connector backshell which provides an enlarged cable exit window to reduce angular distortion and has extended depth to reduce bending stress at the cable contact connections and also provides internal support for such cables and/or the electric contacts thereof.

SUMMARY OF THE INVENTION

Broadly the present invention provides a connector backshell assembly for cables comprising a housing, a first clamp member within the housing to secure the cables and/or their electric contacts therein. A connector is mounted to the housing at the forward end thereof, which engages the cable conductors and/or their contacts and a second clamp member defining a wide exit window, which is mounted to the housing proximate the aft end thereof for further securing the cables as they exit the housing.

The term "coaxial cable" as used herein, includes one or more central conductors surrounded by an insulating or dielectric coating, surrounded in turn, by a tubular conductor e.g. a foil or metal braid shield surrounded in turn, by a further insulating or dielectric coating. The central conductor and shield generally terminate on separate contacts in a terminal.

By 'conductive members' as used herein is meant coaxial cables or one or more metal wires, bars, foils, ribbons, mesh, and the like, with or without insulation.

BRIEF DESCRIPTION OF THE DRAWINGS

The invention will become more apparent from the following detailed specification and drawings in which.

DESCRIPTION OF PREFERRED EMBODIMENT

Figure 1:
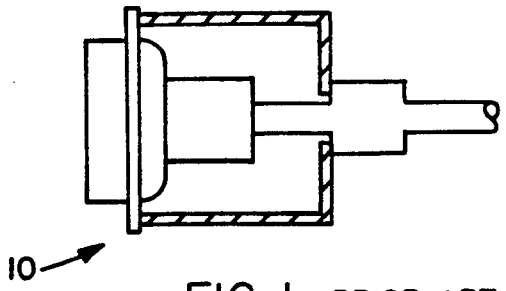
FIG. 1 PRIOR ART
FIG. 1 is a sectional elevation view of a canon backshell of the prior art.
Figure 2:
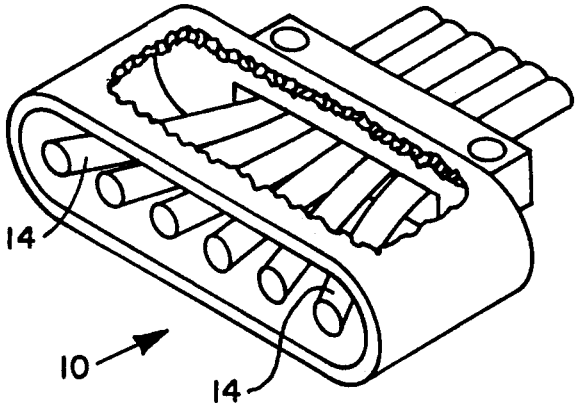
FIG. 2 PRIOR ART
FIG. 2 is an isometric view of the prior art backshell of FIG. 1.
Figure 3:
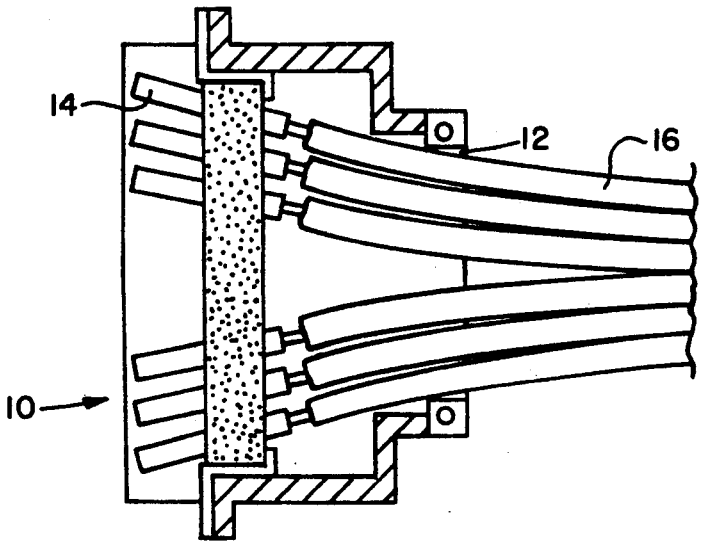
FIG. 3 PRIOR ART
FIG. 3 is a cross-sectional plan view of the canon backshell of FIGS. 1 and 2.

Referring to the invention in more detail, canon backshell 10 of the prior art is shown in FIGS. 1, 2 and 3. As shown, the prior art backshell 10 is shallow in depth and has a relatively small exit window 12 which produces an angular distortion on the outermost contacts 14, and causes them to camber out, as shown in FIGS. 2 and 3. Further the exiting coaxial cables 16 are clamped in a stiff exit bunch and such prior art backshell exhibits the five problems listed above.

Figure 4:
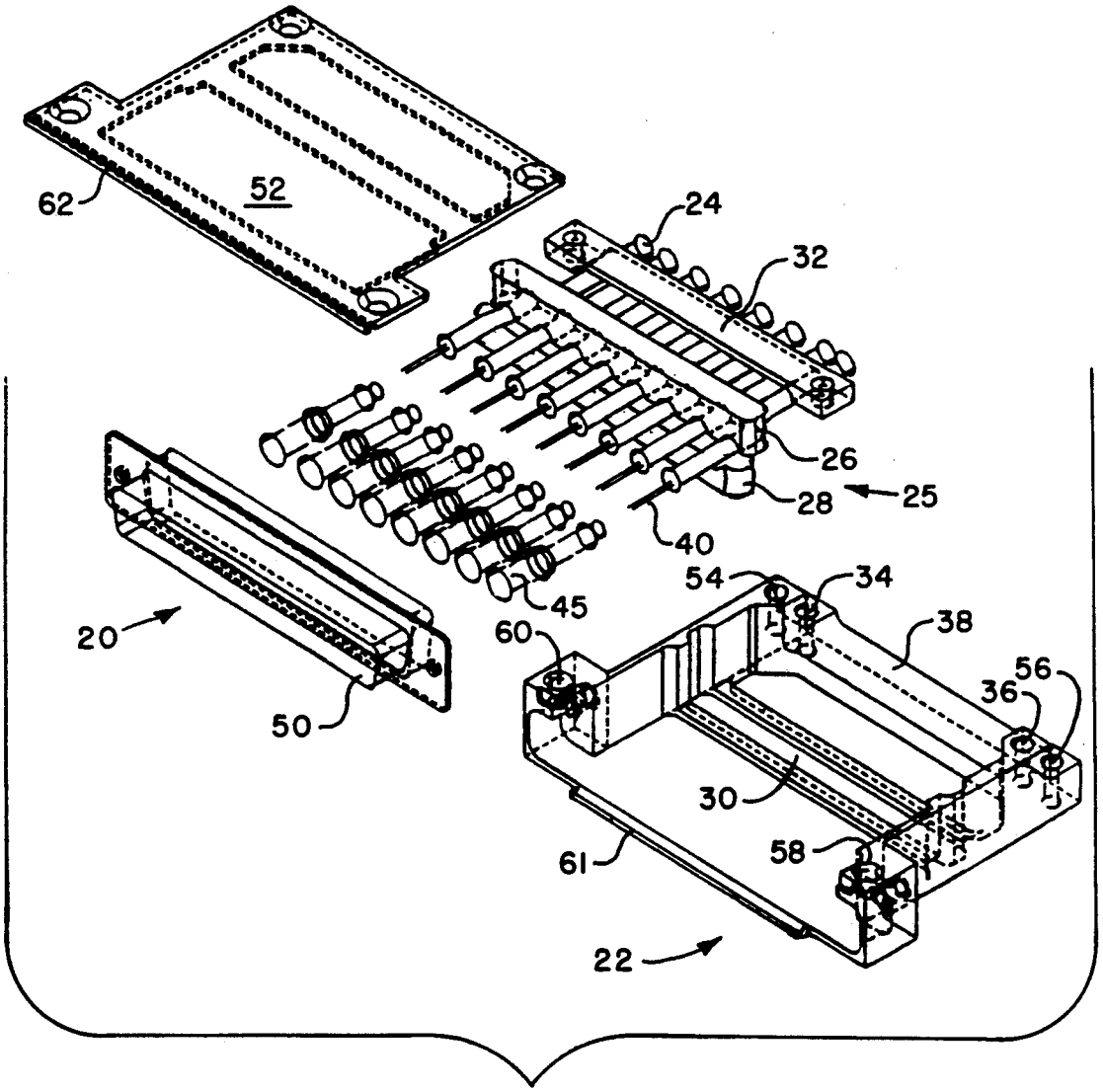
FIG. 4 is an exploded isometric view of a connector backshell assembly embodying the present invention.
Figure 5:
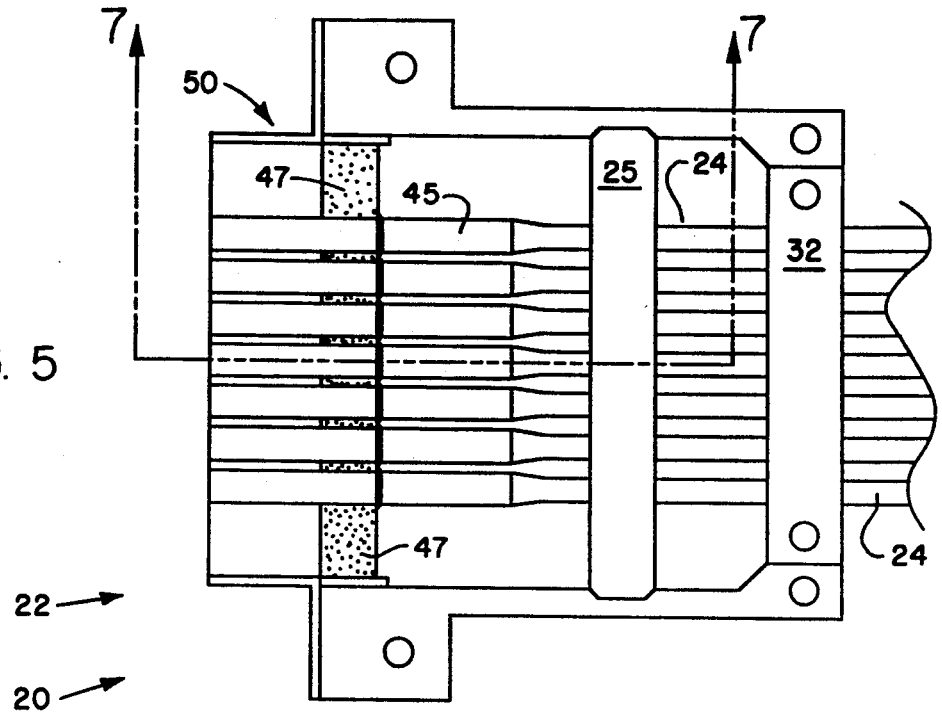
FIG. 5 is a plan view, partly in section, of the connector backshell of FIG. 4, assembled.
Figure 6:
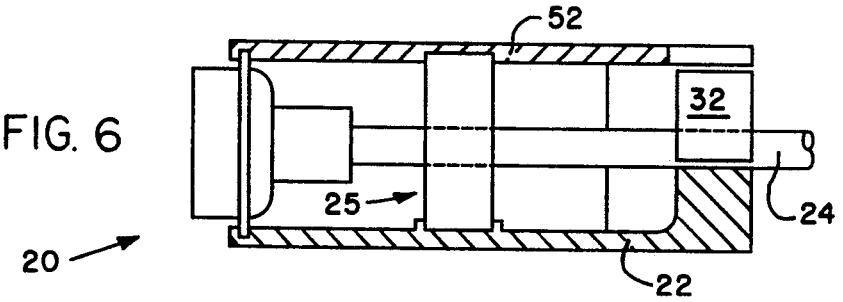
FIG. 6 is a sectional elevation view of the backshell of FIG. 4 assembled.

The connector backshell 20, of the present invention, is shown, e.g. in FIGS. 4, 5 and 6, wherein backshell body 22, as best shown in FIGS. 4 and 5, houses coaxial cables 24 between the halves 26 and 28 of split support 25, the bottom half 28 of which, is mounted in slot 30 of the body member 22, as indicated in FIG. 4 and shown in FIGS. 5 and 6. Cables 24 are also secured to the housing 22 by exterior clamp member 32 which clamp mounts to the body 22 at fastener holes 34 and 36 thereof, to define a wide exit window 38 therebetween, as indicated in FIGS. 4, 5 and 6.

Figure 7:
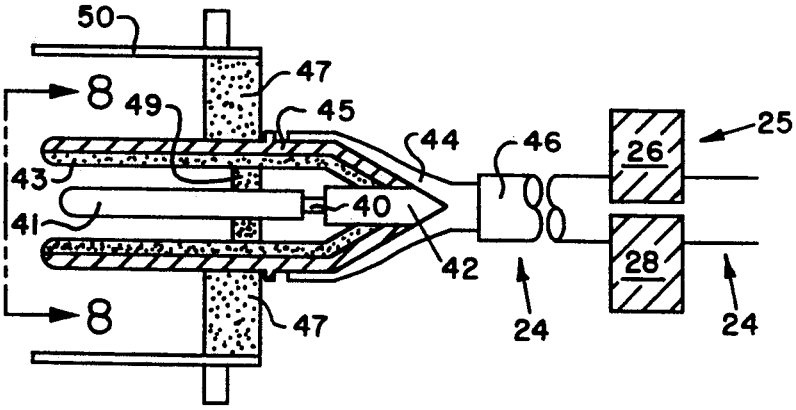
FIG. 7 is an enlarged fragmentary sectional elevation view of a component of the backshell of FIG. 5, taken on lines 7—7, looking in the direction of the arrows
Figure 8:
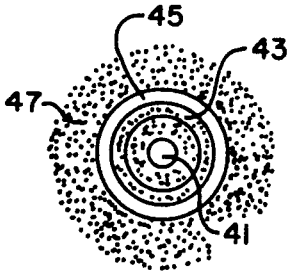
FIG. 8 is an end fragmentary elevation view of the component of FIG. 7, taken on lines 8—8, looking in the direction of the arrows.

As shown in FIG. 7, each coaxial cable 24 has center conductor 40, surrounded by inner dielectric coating 42, surrounded in turn, by conductive sleeve 44, covered in turn, by dielectric sleeve 46. The center conductor 40 is joined with center contact 41 while the conductive sleeve 44 (e.g. a metal braid) engages external tubular contact 45, which is coaxially spaced around center contact 41 and insulated therefrom by dielectric inner sleeve 47, as shown in FIGS. 5 and 7.

The contacts 45 and 41 are held in place in the connector backshell of the invention by dielectric matrices 47 and 49 respectively, as shown in FIGS. 5 and 7.

The coaxial cables 24 with center conductors 40, ready for insertion into tubular contacts 45 and then into connector shell 50, are shown in FIG. 4. The so assembled components are then inserted into the backshell body 22, with the split support 25 being inserted into the body groove 30, as noted above and with the cable clamp 32 being fastened to such body at fastener holes 34 and 36, as indicated in FIG. 4. Thereafter the backshell cover 52 is positioned atop the components thus assembled and attached to the body 22 through the respective fastener holes 54, 56, 58 and 60 thereof, to secure the backshell assembly 20 of the invention, as indicated in FIG. 4 and shown in FIGS. 5 and 6.

Thus, as discussed above and shown in the drawings, the connector backshell assembly of the invention, provides a wide exit window therein so that cables which engage even the outermost contact can extend directly aft through such exit window, without being pinched or angled inwardly and without imparting such angle to the contacts. Further, such cables are doubly secured by the split support 25 and the exit window clamp bar 32, to provide strain relief for such contacts, e.g. as indicated in FIGS. 4, 5 and 6. Further, the exiting cables not being jammed together, have the flexibility, at such exit, to permit the connector backshell to be turned, bent or twisted to a considerable degree relative to the cable proximate and exterior thereto, without imparting angular distortion to the outermost contacts or undue stress on the respective contacts, due to such flexibility and the double clamping support of the backshell of the invention noted above.

The backshell of the invention is suitable not only for coaxial cables and the various types of contacts employed therewith, but is also suitable for various other conductive members, e.g. a central conductor or plurality thereof with or without an insulative coating therearound or other noncoaxial cables or other conductors that can be suitably employed in a wide window backshell with internal and exit clamping supports, according to the present invention. The manner in which the conductors engage the electrical contacts (in the direction of the connector portion) forward of the interior split support member is of secondary concern and may vary, as noted above above, within the scope of the present invention.

However important features of the present invention are 1) double support for conductors within the connector backshell assembly, 2) an enlarged exit window to eliminate angular distortion and reduce bending stress at conductor-contact interface, 3) a multi-piece housing allows, after detaching the cover, the removal of the backshell components, (such as the contacts/conductor assembly) for reworking or repairing and 4) the connector backshell assembly of the invention can have front engaging lips 60 and 62 on body and cover respectively, per FIG. 4, to provide additional support, stability and locking of the backshell to the connector body, e.g. connector body 50 of. FIG. 4.

The backshell body, and cover can be made of metal e.g. aluminum, stainless steel or brass and preferably is of aluminum. The internal split support can be made of plastic, e.g. PTFE or "Teflon"; a polyester such as "nylon" or "delrin" and preferably is of "nylon" while the exit clamp can be made of the above listed metals and preferably of aluminum.

The internal split support can have cable receiving slots or grooves therein or can omit such slots or grooves and make simple contact with a surface of such conductors therebetween.

The exit clamp 32 can be mounted to the backshell body beneath the backshell cover, as shown or indicated in FIGS. 4 and 5 or such exit clamp can be mounted to the backshell body, outside of such cover, as indicated in FIG. 6.

The conductors (by which is meant of the coaxial and non-coaxial type) can be positioned between the double clamps of the backshell of the invention in one or more layers, as desired, within the scope of the present invention.

What is claimed is:

1. A connector backshell assembly for conductive members comprising, a housing, an internal clamp member and an upstanding backing member within said housing positioned to clamp crosswise a plurality of conductive members therebetween, which clamping member and backing member are free of sharp edges, a connector mounted to said housing at the forward end thereof, which connector electrically engages each conductive member and an exit clamp member mounted to said housing proximate the aft end thereof, defining a wide exit window for and further clamping each conductive member as it exits said housing, to provide double support for said conductive members.

2. The backshell assembly of claim 1 wherein said conductive members are coaxial cables or simple conductors or wires.

3. The backshell assembly of claim 1 having a body, an internal clamp member and an exit clamp member that mount thereon and a cover that mounts over said internal clamp member to said body.

4. The backshell assembly of claim 3 wherein said exit clamp member is mounted under said cover.

5. The backshell assembly of claim 3 wherein said exit clamp member is mounted to said body beyond said cover.

6. The backshell assembly of claim 1 wherein said conductive members are coaxial cables which are secured by and extend forward of, said internal clamp member and thence connect with coaxial contacts of a conductor.

7. The backshell assembly of claim 3 wherein said body has a forward engaging lip and said cover has a forward engaging lip to provide additional support, stability and locking of said connector body to said backshell assembly.

8. The backshell assembly of claim 1 wherein at least one of said clamping and backing members contour partly around and across a row of said conductive members to secure same in clamped array.

* * * * *